US009650171B2

(12) United States Patent
Willemsen et al.

(10) Patent No.: US 9,650,171 B2
(45) Date of Patent: May 16, 2017

(54) POURING PACKAGE FOR A FLUID AND POURING ELEMENT THEREFOR

(71) Applicant: Trendzpak Ltd., Labuan F.T. (MY)

(72) Inventors: Louis Rinze Henricus Adrianus Willemsen, Las Pinas (PH); Lucas Karel Johannes van den Broek, GH Zeewolde (NL)

(73) Assignee: TRENDZPAK LTD., Labuan F.T. (MY)

( * ) Notice: Subject to any disclaimer, the term of this patent is extended or adjusted under 35 U.S.C. 154(b) by 0 days.

(21) Appl. No.: 14/760,247

(22) PCT Filed: Jan. 10, 2014

(86) PCT No.: PCT/IB2014/000022
§ 371 (c)(1),
(2) Date: Jul. 10, 2015

(87) PCT Pub. No.: WO2014/108797
PCT Pub. Date: Jul. 17, 2014

(65) Prior Publication Data

US 2015/0353227 A1 Dec. 10, 2015

(30) Foreign Application Priority Data

Jan. 10, 2013 (NL) ..... 2010105

(51) Int. Cl.
*B65D 5/74* (2006.01)
*B65D 39/00* (2006.01)
*B67B 7/00* (2006.01)

(52) U.S. Cl.
CPC ..... *B65D 5/74* (2013.01); *B65D 5/748* (2013.01); *B65D 5/745* (2013.01); *B65D 5/747* (2013.01);
(Continued)

(58) Field of Classification Search
CPC ... B65D 5/24; B65D 5/72; B65D 5/74; B65D 5/748–5/749; B65D 51/18; B65D 51/72;
(Continued)

(56) References Cited

U.S. PATENT DOCUMENTS 4,838,428 A * 6/1989 Rausing ..... B65D 5/72 220/731
4,869,399 A * 9/1989 Dubach ..... B65D 47/0814 222/153.06

(Continued)

FOREIGN PATENT DOCUMENTS

EP 0332800 A2 9/1989
FR 2753174 A1 3/1998

OTHER PUBLICATIONS

International Search Report and Written Opinion of corresponding International Application No. PCT/IB2014/000022; dated May 6, 2014; 7 pages.

*Primary Examiner* — Paul R Durand
*Assistant Examiner* — Andrew P Bainbridge
(74) *Attorney, Agent, or Firm* — Shumaker, Loop & Kendrick, LLP

(57) ABSTRACT

A pouring package for a fluid and a pouring element therefor, including a container provided with a pouring opening which is closed by a seal in an unopened condition of the container. The pouring package is provided with a pouring element at the location of the pouring opening, the pouring element including a breaking element configured to act on and break the seal when a pressure is exerted thereon so as to thus effect an opened condition of the container. The pouring element is provided with two pivot arms extending on either side of the breaking element. Each pivot arm is pivotally connected to the breaking element with a first end and to the pouring element with the opposite, second end. The pouring element is provided with a flexible wall portion
(Continued)

on a side remote from the pouring opening, wherein the flexible wall portion covers only part of the pouring opening.

14 Claims, 4 Drawing Sheets

(52) U.S. Cl.
CPC ..... *B65D 39/00* (2013.01); *B65D 2251/0096* (2013.01); *B67B 7/26* (2013.01)

(58) Field of Classification Search
CPC ..... B65D 17/42; B65D 25/08; B65D 35/28; B65D 47/10; B65D 47/36; B65D 39/00; B65D 2251/0015; B65D 2251/0056; B65D 2251/0096; B65D 41/06; B65D 5/745; B65D 5/747; B67B 7/26; B67B 7/28; B67B 7/24
USPC ..... 222/498–499, 541.1–541.2, 541.5, 222/566–567, 572, 80–91, 539–540; 220/716–718, 255, 258.2; 215/257–258; 229/125.04
See application file for complete search history.

(56) References Cited

U.S. PATENT DOCUMENTS 5,228,592 A * 7/1993 Pellerano ..... B65D 47/36 222/83
5,297,696 A * 3/1994 Bernstein ..... B67B 7/26 222/83
2003/0226855 A1* 12/2003 Allanson ..... B67B 7/26 222/83
2004/0026422 A1* 2/2004 Westphal ..... B65D 51/224 220/277
2005/0269353 A1* 12/2005 Cabelli ..... B65D 1/0292 222/83

* cited by examiner

POURING PACKAGE FOR A FLUID AND POURING ELEMENT THEREFOR

TECHNICAL FIELD AND BACKGROUND OF THE INVENTION

The invention relates to a pouring package for a fluid according to the preamble of claim 1.

The invention further relates to a pouring element for such a pouring package.

Such a pouring package and pouring element are known from EP 1 786 687. In said pouring package, a breaking element is provided between a wall of the pouring element and the seal of the pouring package, which breaking element is able and designed to act on and break the seal when an external pressure is exerted on the wall.

In practice the known pouring package and the known pouring element make it possible to break the seal in an efficient and reliable manner from the outside, i.e. without the user having to come into contact with the flow path of the contents of the package.

It has been found, however, that in some cases breaking the seal does not take place optimally, because the breaking element does not break the seal to a sufficient degree. A part of the seal will impede the flow path in that case, so that an optimum outflow of the fluid is not possible.

French patent document FR 2 753 174 discloses a pouring element which is provided with a breaking element, which is provided above an opening of the pouring package through the use of flexible arms. The placement of the arms enables the breaking element to make a relatively large stroke, so that the seal is broken in a more reliable manner.

A drawback of the pouring element described in said patent document, however, is the fact that a relatively large force is required for opening the outflow opening of the pouring package. In addition, the pouring package that is known therefrom is not hygienic, because the user needs to press on parts of the pouring package which at a later stage will form part of the flow path of the fluid present in the pouring package.

BRIEF SUMMARY OF THE INVENTION

Accordingly it is an object of the present invention to provide an improved pouring package and pouring element of the kind mentioned in the introduction. It is in particular an object to provide a pouring package and a pouring element in which the seal can be broken in an efficient, reliable and hygienic manner.

In order to achieve that object, the invention provides a pouring package of the kind mentioned in the introduction. The pouring element is provided with two pivot arms that extend on either side of the breaking element, wherein each of the pivot arms is pivotally connected to the breaking element with a first end and to the pouring element with the opposite, second end. In the pouring element, the breaking element is connected to the base member of the pouring element via at least two pivot arms that extend on either side of the breaking element, wherein each of the pivot arms is pivotally connected to the breaking element with a first end and to the base member with the opposite, second end. The breaking element is thus connected to the pouring element by means of the two pivot arms, such that the pouring element can undergo a substantially translational movement in the direction of the opening of the pouring element, and even past said opening, relative to the base member of the pouring element. The pivot arms provide a certain spring force, i.e. upon exertion of an external pressure of the breaking element, the pivot arms will assist from a certain point in pressing the breaking element in the direction of the seal and enable the breaking element to move past the opening. The pivot arms are preferably designed so that in the broken condition of the seal the end connected to the breaking element will be located further away from the base member than in the sealed condition. The arms are preferably flexible, so that they may take up a slightly curved position in the sealed condition and be substantially straight in the broken condition of the seal. This provides a large translational movement of the breaking element through the seal and past the opening. As a result of the relatively large stroke, the seal is thus broken in an efficient and reliable manner. An outflow opening is thus created between the breaking element and the base member of the pouring element in that situation, so that a good outflow of the fluid is ensured.

The pouring package according to the present invention is characterised in that it is provided with a flexible wall portion, for example a film, on a side of the pouring element remote from the pouring opening, which flexible wall portion covers only part of the pouring opening. The flexible wall portion extends at least between two opposite sides of the plate-shaped base member of the pouring element and thus covers a relatively large part of the pouring opening. Part of the pouring opening is not covered, however, so that the fluid can flow from the pouring package in a normal manner. When the flexible wall portion is used, a user cannot come into direct contact with the fluid or with the inside of the container of the pouring package upon depressing the breaking element. Contamination of the fluid is thus prevented, so that the fluid may keep longer.

The pouring package according to the present invention is thus a reliable and hygienic package. The object of the present invention is thus achieved.

An additional advantage of the pouring package according to the present invention is the fact that the use of said further wall portion obviates the need to provide a relatively thick "pull-off" aluminium film under the closure, so that a much thinner material, such as a membrane, will suffice.

In a special embodiment, the flexible wall portion can be produced in a simple manner by making use of so-called in-mould labelling technology. The pouring element is in that case produced by injection-moulding, in which case the flexible wall portion is already present in the mould in the form of a film. By making use of the same materials, an indissoluble bond between the breaking element, the base member and the flexible wall portion in the form of a film is obtained in that case.

In one embodiment, the flexible wall portion is attached or connected to the breaking element, and in particular also to the pivot arms. The wall portion is thus connected to the pouring element in an efficient manner. It is furthermore conceivable that the flexible wall portion is also connected to at least three sides of the plate-shaped base member of the pouring element. The pouring element may in that case be provided, on one side thereof, with an edge element that extends arcuately above said side, to which edge element the flexible wall portion is attached. Thus, an outflow opening for the fluid is formed between that side of the plate-shaped base member and the edge element. A compact and hygienic pouring element is thus provided in an efficient manner.

In order to effect a relatively large translational movement of the breaking element, the pivot arms exhibit a substantially L-shaped curvature in one embodiment.

In one embodiment, the pouring element is provided with a pivotable cover which, in a closed position thereof, covers the pouring opening and the breaking element and which, in an open position thereof, releases the pouring opening such that the fluid can be poured from the container in an opened condition of the container.

In one embodiment, in which the breaking element is stabilised during its movement, the pouring package comprises a further pivot arm extending transversely to the pivot arms, which further pivot arm is pivotally connected to the breaking element with a first end and to the pouring element with the opposite end.

In a possible embodiment, the pouring package comprises two further pivot arms extending on either side of the breaking element, which further pivot arms extend substantially transversely to the pivot arms, wherein the further pivot arms are each pivotally connected to the breaking element with a first end and to the pouring element with the opposite end. In this way the movement of the breaking element is further restricted, such that breaking element essentially undergoes a translational movement, substantially in a direction transversely to the plane formed by the plate-shaped body of the pouring element. The further pivot arms provide an additional pushing force upon opening of the pouring package.

In one embodiment, the pivot arms are designed so that they are located substantially entirely in the interior of the container in an opened condition of the pouring package.

In order to improve the breaking of the seal, the breaking element in one embodiment comprises a plate-shaped cutting element, which extends substantially transversely to the plane formed by the seal. The plate-shaped cutting element thus extends transversely to the plane formed by the plate-shaped base member, so that an edge of the plate-shaped cutting element will first reach the seal and can subsequently pierce the seal and/or cut therethrough.

In one embodiment, an edge of the plate-shaped cutting element forms a cutting face in that case, wherein at least part of the cutting face extends at an angle relative to the plane formed by the seal in an unopened condition of the package. By this is meant that the linear cutting face extends at an angle relative to the plane formed by the seal and is not disposed parallel thereto, therefore. When the breaking element is pushed down, the cutting face will therefore come into contact with the seal in a point. In this way a very large pressure is built up at the location of the point contact, as a result of which the seal is broken in a simple and reliable manner. It is, incidentally, conceivable that the cutting face is provided with parts that in turn extend at an angle relative to each other, such that the breaking element does not come into contact with the seal in one point but in two or even more points. Preferably, the pouring element comprises two parts extending at an angle relative to each other, so that only two spaced-apart parts of the cutting element will come into contact with the seal.

In one embodiment, at least the two ends of the cutting face extend at an angle relative to the seal. The breaking element is preferably designed so that the two ends of the cutting face will first come into contact with the seal upon downward movement of the breaking element. The part of the cutting face that is located between the two ends is disposed relatively further away, i.e. the cutting face has a concave configuration, so that this further-away part will come into contact with the seal later than said ends.

It is conceivable in that regard that at least a part of the cutting face that is located between the ends of the cutting face extends substantially parallel to the seal. Said part will in that case form a line contact with the seal after the seal has already been partially broken, so that the seal will be pushed through and be pushed aside slightly when the breaking element is pushed further so as to thus create a flow path for the fluid.

In one embodiment, the pivot arms are configured so that the breaking element will make a large stroke upon being pushed downward, such that the seal will be broken and be pushed aside so as to release a tunnel-shaped outflow opening. An edge of the seal thus forms an outflow opening, the shape and the size of which is determined by the pivot arms. The breaking element can thus be of simple design, without additional means for providing a tunnel-shaped outflow opening.

BRIEF DESCRIPTION OF THE DRAWINGS

The invention will now be explained in more detail by way of illustration with reference to a few embodiments shown in the appended figures, in which.

DETAILED DESCRIPTION OF THE INVENTION

Figure 1A:
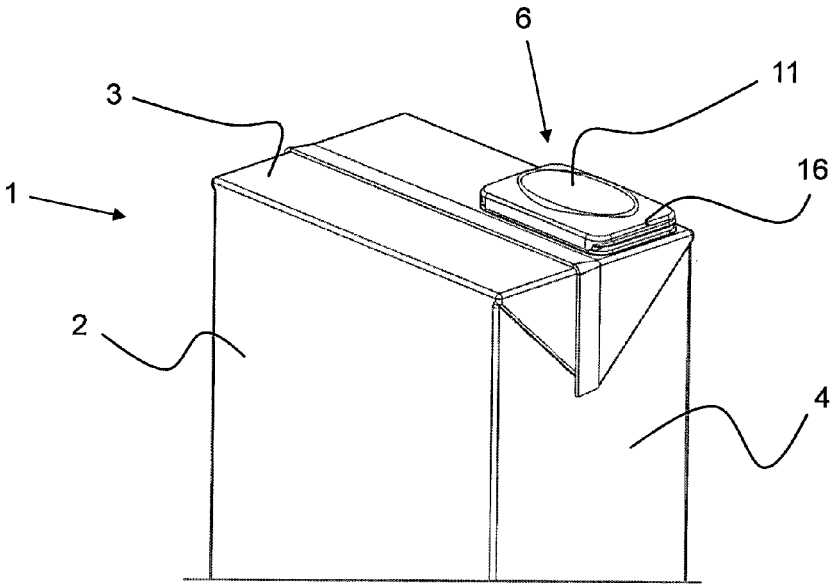
FIGS. 1*a* and 1*b* are, respectively, a perspective view of a pouring package provided with a pouring element according to the present invention and a partially sectional side view of the pouring element of FIG. 1*a*, in a closed position of the pouring element.

FIG. 1 shows a pouring package 1 for a fluid, comprising a container 1 substantially impermeable to the fluid, which container is formed by a number of walls 2, 3, 4. The upper wall 3 of the container 1 is provided with a pouring opening 5 (not shown in this figure) which is covered by a pouring element 6. The pouring package 1 is for example a carton for a fluid such as milk, yoghurt, apple juice or other liquid or semi-liquid products. Such packages and contents are known per se to the skilled person, and consequently the invention is not restricted to the type of fluid that is present in the package 1. It is noted in this regard that also non-consumable products can be contained therein.

FIG. 1*a* shows the pouring element 6 in an unopened condition of the container 1, in which a pouring element 6 provided with a cover 6 covers a pouring opening 5 (not shown). The cover 11 comprises an engaging lip 16.

Figure 1B:
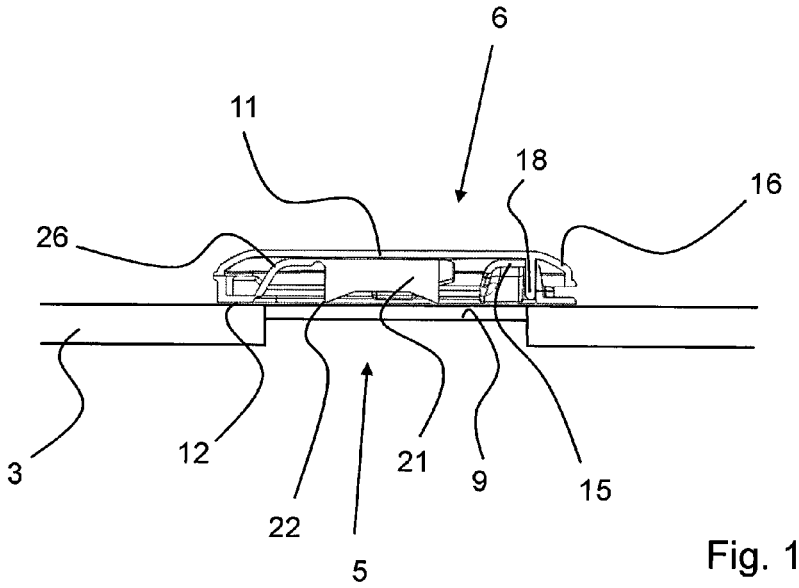

FIG. 1*b* is a partially sectional side view of the pouring element 6, in the condition shown in FIG. 1*a*. The pouring element 6 comprises a substantially rectangular base member 12, in which an opening is formed. The base member 12 of the pouring element 6 is attached to the pouring opening 5 in the upper wall 3, which is covered by the seal 9, in a manner which is known to the skilled person, such that the opening of the base member 12 is substantially in line with the pouring opening 5 to be formed in the pouring package 1. Provided at the location of the opening of the base member 12, and in line with said opening, is a breaking element 21. The breaking element 21 is provided with two sharp points 22, 24 on an underside thereof, at least the side that faces the seal 9, which can be used for breaking the seal. The breaking element 21 comprises a few pivotable arms 26, 27 (only a rear arm 26 is shown in FIG. 1*b*), which arms 26, 27 connect the breaking element 21 to the base member 12 of the pouring element 6. Using film hinges, the arms 26, 27 are configured so that they can pivot at the location of the transition between the base member 12 and the arms 26, 27 on the one hand and at the location of the transition between the arms 26, 27 and the breaking element 21 on the other hand. In the situation shown in FIG. 1*b*, the breaking element 21 is located at an upper side of the base member 12, and that in such a manner that the breaking element 21 is positioned above the seal 9 of the pouring opening 5, preferably some distance above said seal 9. Located at the front side of the pouring element 6 is an outflow channel 31, via which fluid can flow out in a broken condition of the seal 9.

The cover 11, which is slightly rigid, prevents a user from moving the breaking element 21 downward via said cover 11, however, such that unintentional opening of the package 1 is not possible. The cover 11, which is clamped in the base member 12 by means of a locking element 18, can be moved to an open position by a user when the user engages the lip 16 of the cover 11 that is provided at the front side.

Figure 2A:
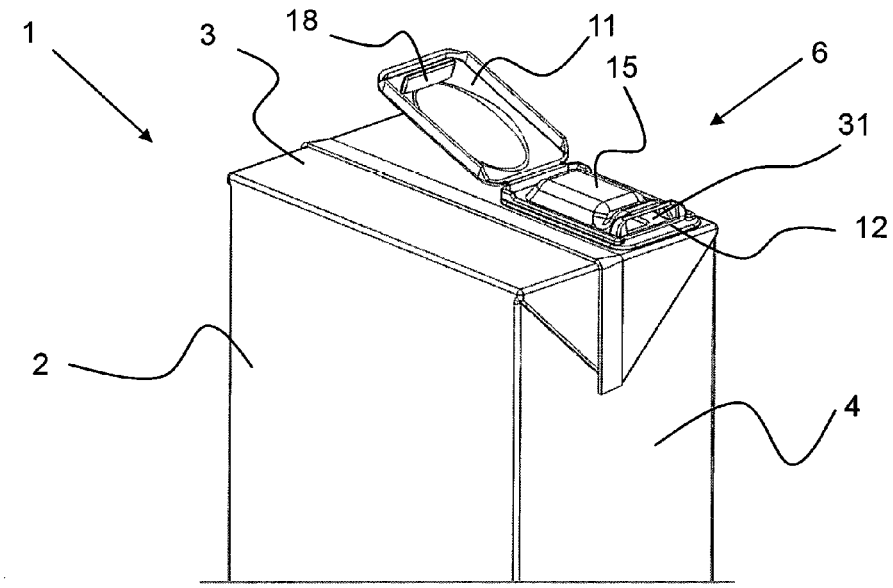
FIGS. 2*a* and 2*b* are a perspective view of the pouring package of FIG. 1*a* and a partially sectional side view of the pouring element of FIG. 1*b*, respectively, in which a cover of the pouring element is in the open position thereof.
Figure 2B:
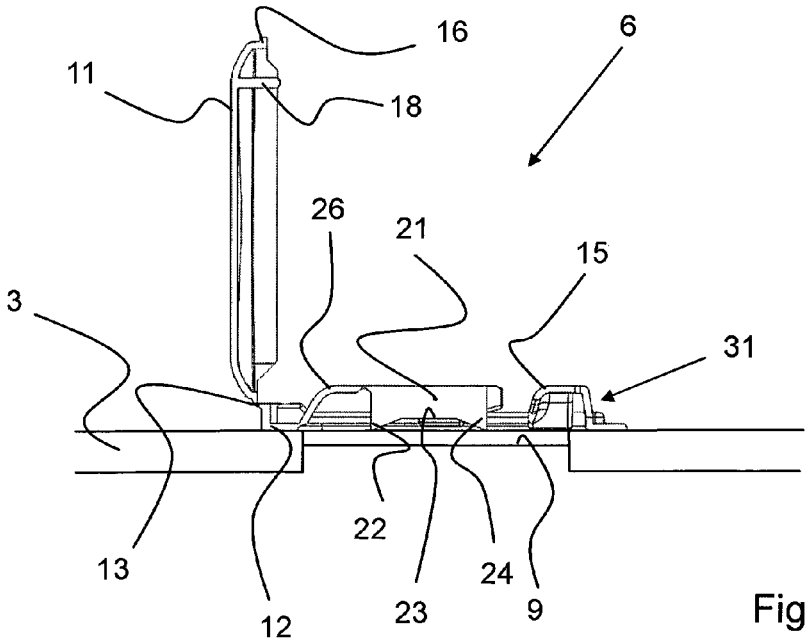

When the cover 11 is pivoted upward by the user, the situation shown in FIGS. 2*a* and 2*b* is obtained. The cover 11 of the pouring element 6 has been moved up, as a result of which the breaking element 21, which is covered by a flexible wall portion 15 that is provided on a side of the pouring element 6 remote from the pouring opening 5, is accessible to a user. The wall portion 15 covers only part of the pouring opening 5, because an outflow opening 31 of the pouring element 6 is not covered by the wall portion 15 at the front side and fluid can thus flow freely therethrough—providing that the seal 9 is broken.

In the situation shown in FIGS. 2*a* and 2*b*, the breaking element 21 can be moved downward by a user so as to thus break the seal 9 in the wall portion 3 and release the outflow opening. The double pivoted attachment of the arms 26, 27 enables the breaking element 21 to break the seal 9 that is present on the pouring opening 5, as will be explained below with reference to FIGS. 3*a* and 3*b*.

Figure 3A:
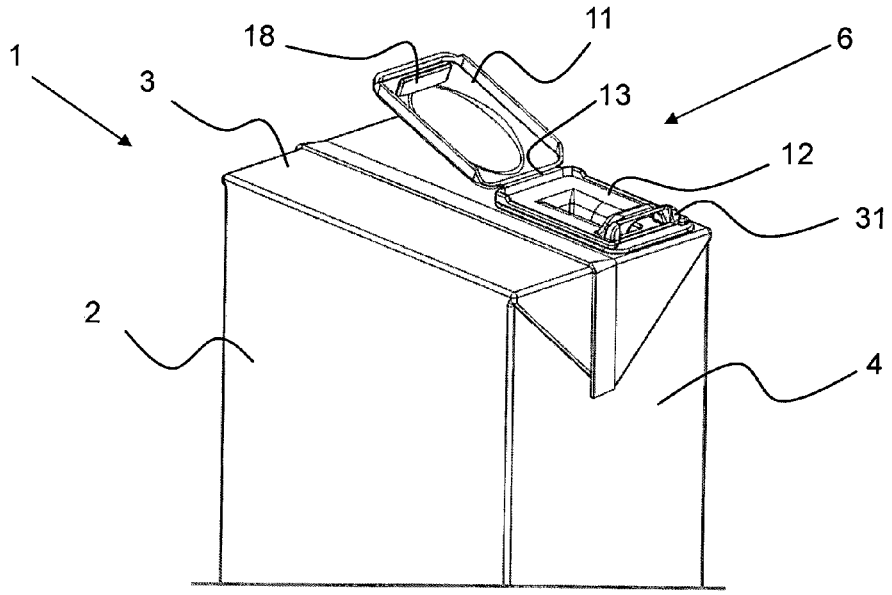
FIGS. 3*a* and 3*b* are a perspective view of the pouring package of FIG. 1*a* and a partially sectional side view of the pouring element of FIG. 1*b*, respectively, in which a cover of the pouring element is in the open position and the seal has been broken by a breaking element of the pouring element.
Figure 3B:
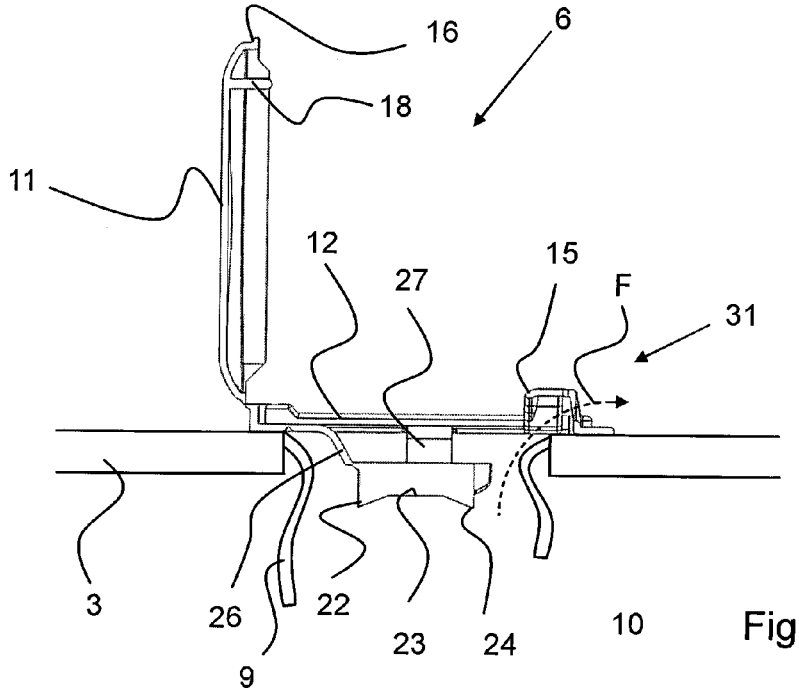

FIGS. 3*a* and 3*b* shows the situation in which the breaking element 21 has been pressed down, past the base member 12, and through the seal 9. In that situation, the outflow opening 5 (see FIG. 1*b*) is released, because the seal 9 has been pushed aside (shown schematically in FIG. 3*b*), and a flow path F extends from the inside of the container 1, via the outflow channel 31, to outside the container 1, such that the fluid can flow from the container 1. If the user wishes not to use of the pouring package 1 temporarily, the user can return the cover 11 to the position shown in FIGS. 1*a* and 1*b*, in which the cover 11 firmly engages the base member 12 by means of the locking element 18, and the flow path F is interrupted at the location of the outflow opening 31. Undesired outflow of fluid from the container 11 is not possible in this situation.

Figure 4:
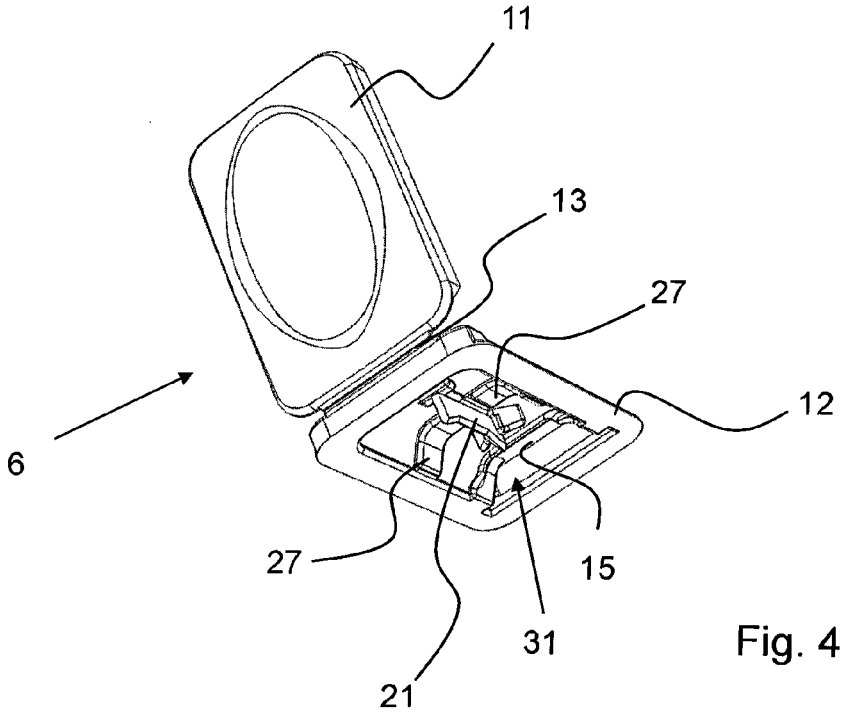
FIG. 4 is a perspective bottom view of the pouring element according to the invention as shown in FIGS. 2*a* and 2*b;*
Figure 5:
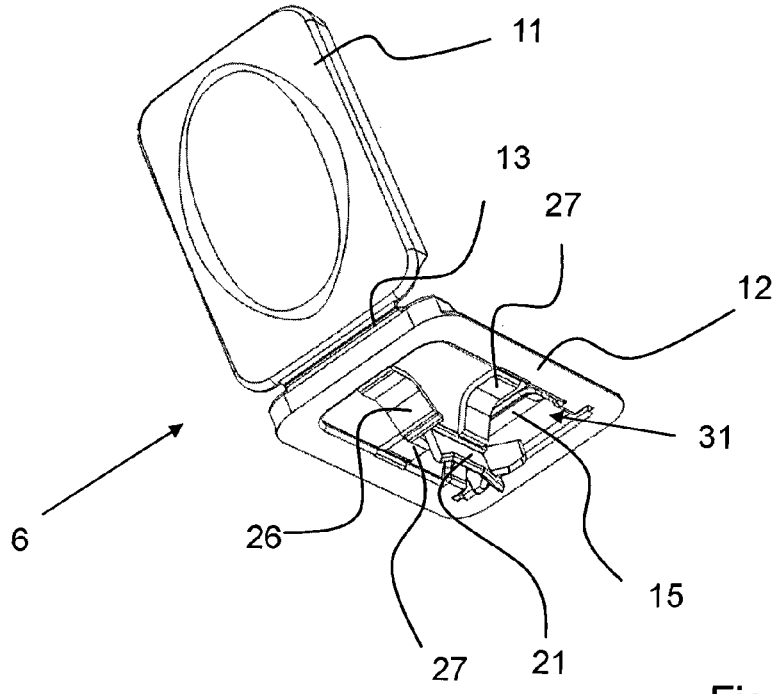
FIG. 5 is a perspective bottom view of the pouring element according to the invention as shown in FIGS. 3*a* and 3*b.*

The pouring element 6 and the breaking element 21 thereof will be explained in more detail with reference to FIG. 4 and five, which show the pouring element 6 in a deactivated position and in an activated position, respectively. As FIGS. 4 and 5 show, the breaking element 21 is a substantially plate-shaped element 21, which is provided with a breaking profile on an underside thereof. As is more clearly shown in FIG. 3*b*, said breaking profile comprises a point 22 provided at a first end, as well as a further point 24 located at the opposite end. Between the pointed ends, the breaking element is concave or hollow, i.e. the points 22, 24 are provided closest to the seal 9 in a non-activated position of the breaking element 21. The edge formed by the underside of the breaking element 21 is configured as a cutting edge in the embodiment shown in FIG. 4 and FIG. 5, i.e. the edge is relatively sharp, so that it can easily cut through the seal 9.

The pivot arms 26, 27 or spring arms 26, 27 attach the breaking element 21 to the rectangular base member 12 of the pouring element 6. The spring arms 26, 27 are configured so that the breaking element can make a relatively large stroke upon being pushed down, so that the seal 9 is broken and pushed aside so as to release the tunnel-shaped outflow opening 31, via the flow path F. In spite of this, the pouring element 6 only has a small height in an unopened condition.

Because two arms 27 are provided on either side of the breaking element 21, which arms are L-shaped or C-shaped, said arms provide a pushing or assisting force when the breaking element 21 is being pushed down. When the breaking element 21 is moved past a particular point, the arms 27 will push the breaking element 21 further downward. The arms 27 thus assist in the breaking of the seal 9. The seal 9 can thus be broken in a simple manner by the user, without exerting a large force. The further arm 26, which extends transversely to the previously described arms 27, provides stability, such that the breaking element 21 cannot swing aside.

The pouring element 6 can be efficiently produced, substantially in its entirety (at least with the exception of the flexible wall portion 15) by means of an injection-moulding technique. To that end a film, which will form the flexible wall portion 15 at a later stage and which in that capacity closes the pouring opening 5 at the upper side and ensures that only the flow path F via the outflow opening will be free when the seal 9 is broken, is laid in a mould that is suitable for that purpose. The film comes from a roll, for example, which enters the mould on one side and exits the mould again on another side. Upon closing of the mould, the film already undergoes a thermoforming treatment: from a flat shape it is pressed into a cup shape. During the injection-moulding process, the pouring element 6 with the flexible wall portion is thus formed. This end product is present on the long roll of film that forms the flexible wall portion 15. The roll can be moved a little further, whereupon the injection-moulding process is repeated. The end product is then a roll of film comprising a large number of pouring elements 6. The individual pouring elements 6 can be removed to size from the roll, whereupon they can be placed directly on the container 1 of the pouring package 1, in a manner that is known per se to the skilled person.

In a preferred embodiment, the pouring element 6 is made of polypropylene (PP). The flexible wall portion 15 may also be made of PP in that case, which has the advantage that the two materials bond together, so that they are inextricably bound together during the production process. Alternatively, polyethylene may be used.

In the embodiment described above, the pouring element 6 has a weight of about 1.7 g, which constitutes a major saving in comparison with the about 2.7 g of current closures that are known to the applicant.

The skilled person will appreciate that the invention has been described in the foregoing with reference to a few possible embodiments, which are preferred will stop the invention is not limited to these embodiments, however. Many modifications are conceivable within the framework of the invention. The protection being sought is defined by the appended claims.

The invention claimed is:

1. A pouring package for a fluid, comprising:

(a) a container substantially impermeable to the fluid and having a pouring opening formed on the container that is closed by a breakable seal, (b) a pouring element fixed on the container that surrounds the pouring opening, the pouring element comprising:

(i) a curved partial enclosure having sidewalls and a top wall defining an opening that is in fluid communication with the pouring opening formed on the container when the pouring opening is opened, the top wall of the curved partial enclosure extends over the opening that is in fluid communication with the pouring opening and extends outwardly from the pouring element;

(ii) a breaking element adapted to break the seal when a pressure is exerted thereon to open the container, and (iii) a flexible wall portion directly attached to a top portion of the breaking element that forms an enclosure, wherein:

the pouring element has two pivot arms extending on either side of the breaking element, each of the pivot arms pivotally connected to the breaking element at a first end and to the pouring element at the opposite, second end, the flexible wall portion is spaced apart from the opening of the pouring element, and the flexible wall portion of the pouring element covers only part of the pouring opening.

2. The pouring package according to claim 1, wherein the pivot arms are substantially L-shaped.

3. The pouring package according to claim 1, wherein the pouring element has a pivotable cover which, in a closed position thereof, covers the pouring opening and the breaking element and which, in an open position thereof, releases the pouring opening such that the fluid can be poured from the container through the opening of the pouring element.

4. The pouring package according to claim 1, comprising a further pivot arm extending transversely to the pivot arms, wherein the further pivot arm is pivotally connected to the breaking element at a first end and to the pouring element at the opposite end.

5. The pouring package according to claim 1, wherein the pivot arms are located substantially entirely in the interior of the container in an opened condition of the pouring package.

6. The pouring package according to claim 1, wherein the breaking element comprises a plate-shaped cutting element that extends substantially transversely to a plane formed by the seal.

7. The pouring package according to claim 6, wherein an edge of the plate-shaped cutting element forms a cutting face that extends at an angle relative to the plane formed by the seal in an unopened condition of the package.

8. The pouring package according to claim 7, wherein the plate-shaped cutting element comprises two spaced apart cutting faces formed on opposing sides of the plate shaped cutting element, each cutting face extends at an angle relative to the plane formed by the seal in an unopened condition of the package.

9. The pouring package according to claim 8, wherein the plate shaped cutting element comprises a recessed portion positioned between the two spaced apart cutting faces that extends substantially parallel to the seal.

10. The pouring package according to claim 4, wherein the pivot arms are configured so that the breaking element makes a large stroke upon being pushed downward, such that the seal is broken and pushed aside so as to release a tunnel-shaped outflow opening.

11. The pouring package according to claim 1, wherein the flexible wall portion is attached to the pivot arms.

12. The pouring package according to claim 1, further comprising a cover that is hingedly connected to the pouring element and adapted for opening and closing the curved partial enclosure, the cover having an end portion adapted for grasping to open and close the cover and a vertical wall spaced apart from the end portion that is adapted to directly contact and close the opening of the curved partial enclosure when cover is closed.

13. A pouring element for a pouring package for a fluid, the pouring element comprising:

a plate-shaped base member having a curved partial enclosure having sidewalls and a top wall defining a through opening configured to be in fluid communication with the pouring package;

a breaking element connected to the plate-shaped base member, the breaking element having a flexible wall portion directly attached thereon that forms an enclosure; wherein:

the breaking element is placed on a first side of the base member and is configured to move in the direction of the second side of the base member remote from the first side when a pressure is exerted thereon, and the breaking element is connected to the base member via at least two extending pivot arms each pivotally connected to the breaking element at a first end and to the base member at the opposite, second end, the flexible wall portion is spaced apart from the through opening of the plate-shaped member; and the flexible wall portion covers only part of the pouring opening, wherein:

the top wall of the curved partial enclosure extends over the through opening and extends outwardly from the pouring element.

14. The pouring element according to claim 13, further comprising a cover that is hingedly connected to the pouring element and adapted for opening and closing the curved partial enclosure, the cover having an end portion for grasping adapted to open and close the cover and a vertical wall spaced apart from the end portion that is adapted to directly contact and close the opening of the curved partial enclosure when cover is closed.

* * * * *